United States Patent [19]

Nagashima et al.

[11] Patent Number: 4,936,271

[45] Date of Patent: Jun. 26, 1990

[54] PORTABLE POWERED WORKING MACHINE

[75] Inventors: Akira Nagashima, Kawasaki; Hiroaki Koga, Sayama; Tsutomu Ogata, Tachikawa, all of Japan

[73] Assignee: Kioritz Corporation, Tokyo, Japan

[21] Appl. No.: 363,743

[22] Filed: Jun. 9, 1989

[30] Foreign Application Priority Data

Jun. 10, 1988 [JP] Japan ..... 63-76951[U]
Jun. 10, 1988 [JP] Japan ..... 63-76952[U]
Jun. 10, 1988 [JP] Japan ..... 63-76953[U]

[51] Int. Cl.[5] ..... F02F 7/00

[52] U.S. Cl. ..... 123/195 C; 123/195 R; 123/195 HC; 123/198 E; 30/381

[58] Field of Search ..... 123/41.67, 41.7, 195 R, 123/195 C, 195 HC, 198 E; 30/381; 181/229, 240

[56] References Cited

U.S. PATENT DOCUMENTS 3,204,619 9/1985 Rubinowitz et al. ..... 123/74 A
3,734,070 5/1973 Kobayashi et al. ..... 123/195 R
3,994,067 11/1976 Hazzard et al. ..... 30/381
4,370,809 2/1983 Takahashi et al. ..... 30/381
4,382,333 5/1983 Nagashima et al. ..... 30/381
4,548,169 10/1985 Nagashima ..... 123/195 C
4,592,445 6/1986 Sawada ..... 181/229
4,783,207 11/1988 Nagashima et al. ..... 123/198 E

FOREIGN PATENT DOCUMENTS 2718109 8/1984 Fed. Rep. of Germany .

*Primary Examiner*—Noah P. Kamen
*Attorney, Agent, or Firm*—Browdy & Neimark

[57] ABSTRACT

A portable powered working machine such as a chain saw has a casing, a hollow grip formed integrally with the casing and extending from a front portion to a rear portion of the upper wall of the casing. An internal combustion engine is disposed in the casing such that its crankshaft extends transversely of the casing, the internal combustion engine having a cylinder arranged horizontally in a rear portion of the casing and a crankcase disposed in a front portion of the casing. A carburetor is disposed on a front side of the crankcase, while an air cleaner disposed in a rear portion of the grip. A communication pipe extends through the grip portion in the longitudinal direction thereof and connected between the air cleaner and the carburetor so as to form an air passage.

3 Claims, 1 Drawing Sheet

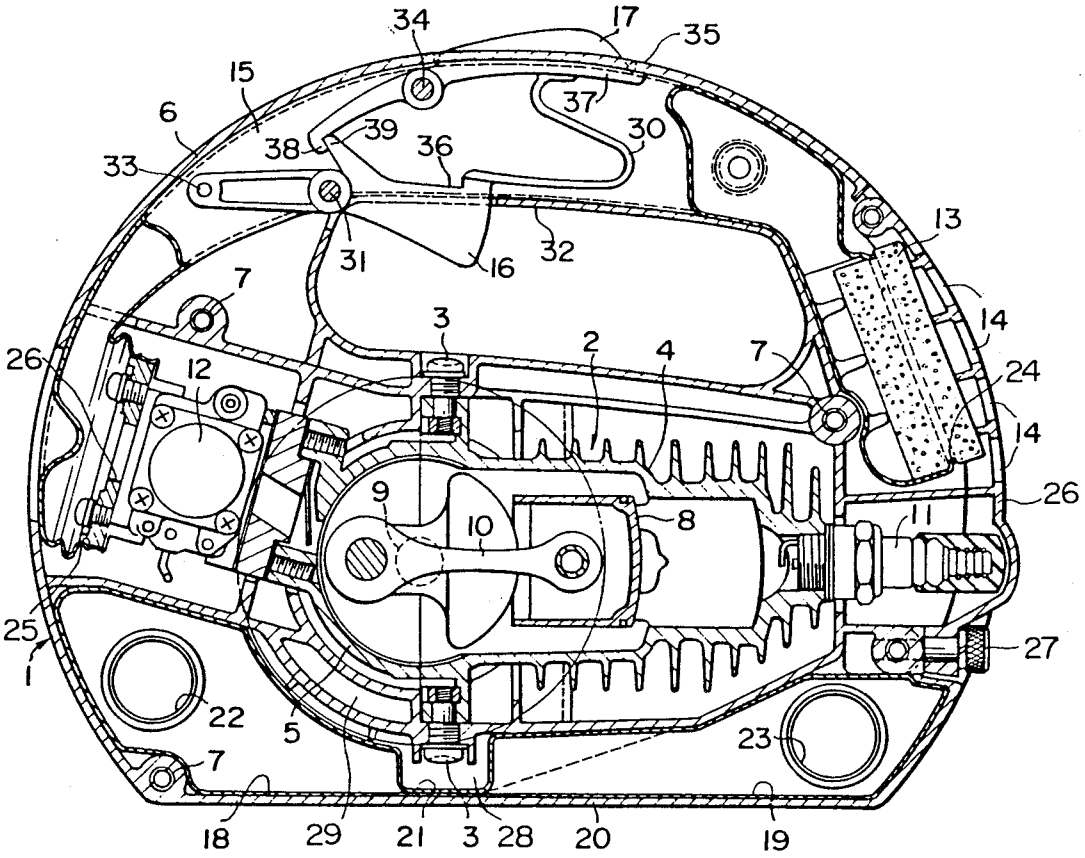
26
27
24
14
14
13
11
7
23
19
35
8
4
17
30
2
20
37
32
28
16
10
3
3
36
34
21
39
9
31
29
38
5
15
7
22
18
12
7
6
33
26
25
1

PORTABLE POWERED WORKING MACHINE

BACKGROUND OF THE INVENTION

The present invention relates to a portable powered working machine such as a chain saw.

In general, a chain saw as an example of portable powered working machines has an internal combustion engine as the power source encased in a restricted space in a small casing. A carburetor and an air cleaner through which cleaned air is introduced to the carburetor are also mounted in the casing. The conventional chain saw, however, is generally difficult to handle and tends to rapid contamination of the air cleaner with the result that the engine performance is impaired undesirably. The contaminated air cleaner generates a large noise when air is sucked therethrough. At the same time, the mixture tends to be blown back from the carburetor to the air cleaner by the back pressure transmitted from the engine, undesirably accelerating the contamination of the air cleaner.

The chain saw has, in addition to the internal combustion engine as the power source, a fuel tank storing the fuel to be supplied to the engine and a lubricating oil tank storing a lubricating oil which lubricates the engine and the saw chain, the tanks also being encased in the casing. In known chain saws, the fuel tank and the lubricating oil tank are provided in the casing independently separately from each other, so that the number of parts is undesirably increased to make it difficult to realize a compact construction. In addition, much cost and time are required for the fabrication and assembly of the chain saw.

The power of a working machine such as a chain saw or a hedge cutter is controlled by manipulating a throttle lever of the internal combustion engine. In order to prevent any unintentional movement of the throttle lever, it is necessary to provide a throttle lock-out device. Conventionally, in this type of working machine, the throttle lever, the throttle lock-out device and a spring for biasing the throttle lock out device are formed as separate members and are assembled independently. In consequence, the number of parts is increased and much time and labor are required for the assembly of these parts.

SUMMARY OF THE INVENTION

Accordingly, an object of the present invention is to provide a portable powered working machine which is small in size and light in weight and which can conveniently be handled, thereby overcoming the above-described problems of the prior art.

To this end, according to the present invention, there is provided a portable powered working machine comprising: a casing; a hollow grip formed integrally with the casing and extending from a front portion to a rear portion of the upper wall of the casing; an internal combustion engine disposed in the casing such that its crankshaft extends transversely of the casing, the internal combustion engine having a cylinder arranged horizontally in a rear portion of the casing and a crankcase disposed in a front portion of the casing; a carburetor disposed on a front side of the crankcase; an air cleaner disposed in a rear portion of the grip; and a communication pipe extending through the grip portion in the longitudinal direction thereof and connected between the air cleaner and the carburetor so as to form an air passage.

Thus, in the portable powered working machine of the present invention, the air cleaner and the carburetor are disposed on opposite sides of the casing, and the air cleaned by the air cleaner is introduced into the carburetor through a comparatively long communication pipe which extends through the grip in the longitudinal direction. More specifically, according to the invention, an internal combustion engine is arranged in the casing such that the crankshaft of the engine extends transversely of the case and the air cleaner and the communication pipe leading to the carburetor is provided in the grip, thus realizing a compact construction which can conveniently be handled. In addition, the air cleaner is disposed on the rear portion of the machine so that the contamination of the air cleaner is suppressed to improve the performance of the cleaner. In addition, since the air cleaner is provided on the opposite side of the carburetor in the casing via the comparatively long winding communication pipe, so that the blow-back of the mixture to the air cleaner from the carburetor can be avoided.

Another object of the present invention is to provide a portable powered working machine in which a fuel tank and a lubricating oil tank are integrally connected with each other so as to enable the number of parts to be reduced, the structure for connecting the fuel tank and the lubricating oil tank is flexible so as to facilitate the mounting of the fuel tank and the lubricating oil tank can be easily done in the casing, the lubrication oil in the lubrication oil tank being suitably heated by the heat from the internal combustion engine so as to maintain the required lubricating performance, while the fuel tank is kept away from the engine to minimize the temperature rise of the fuel by the heat from the engine, thus realizing a smooth operation of the internal combustion engine.

Still another object of the present invention is to provide a portable powered working machine in which a throttle lever, a throttle lock-out and a biasing spring are formed as an integral part so as to reduce the number of the parts of the machine, thereby facilitating the assembly and reducing the production cost.

BRIEF DESCRIPTION OF THE DRAWING

The attached sole FIGURE is a longitudinal sectional view of a chain saw which is an embodiment of the portable powered working machine of the present invention.

DESCRIPTION OF THE PREFERRED EMBODIMENT

The invention will be more fully understood from the following description of a preferred embodiment taken in conjunction with the accompanying drawing.

Referring to the attached sole FIGURE, a chain saw has a casing 1 made of a suitable material such as a plastic. An internal combustion engine 2 is installed in the casing 1 such that its crankshaft extends transversely thereof, and fixed to the casing 1 by means of a plurality of screws 3. The internal combustion engine 2 has a cylinder 4 which is laid horizontally in a rear portion of the casing 1 such that a crankcase 5 of the engine 2 is disposed in a front portion of the casing 1. The casing 1 is provided at its upper portion with a substantially arch-shaped hollow grip 6 which extends from the front to rear side of the casing 1 and which is formed integrally with the casing 1. The casing 1 is opened at its one side which is perpendicular to the plane of the drawing so as to enable various parts to be assembled in the casing 1. This opened side of the casing 1 is adapted to be closed by a cover which is not shown and which is adapted to be secured to the casing by means of screws which are screwed into threaded holes 7 formed in the casing 1.

The internal combustion engine 2 used in this embodiment is an air-cooled 2-cycle engine having a piston 8 reciprocatably received in the cylinder 4. The piston 8 is connected through a connecting rod 10 to a crankshaft 9 rotatably mounted in the crankcase 5. The cylinder 4 is provided at its end with a spark plug 11, while a diaphragm-type carburetor 12 is provided on the front side of the crankcase 5 so as to supply air-fuel mixture to the crankcase 5.

An air cleaner 13 having an element made of a sponge-like foam rubber is provided in a rear portion of the grip 6 of the casing 1. Air induced through an air inlet 14 formed in a rear portion of the grip 6 is introduced into the air cleaner 13. A communication pipe 15 which hermetically interconnects the air cleaner 13 and the carburetor 12 is provided in the grip 6. The communication pipe 15 is made of a thin-walled hollow member made of a plastic such as polypropylene or polyethylene, and is disposed in such a manner as to extend through the grip 6 from the rear to the front. The communication pipe 15 has a rear end opening 24 to which the air cleaner 13 is hermetically connected and a front end opening 25 to which the suction port 26 of the carburetor 12 is hermetically connected, so that the air cleaned by the air cleaner 13 is introduced into the carburetor 12 through the communication pipe 15. Since the air cleaner 13 is disposed in the rear portion of the grip 6 which is provided on the rear portion of the casing 1, the air cleaner 13 can maintain the required air cleaning performance for a long time without being rapidly contaminated. The communication pipe 15 interconnecting the air cleaner 13 and the carburetor 12 provides a comparatively long and winding air passage extending through the grip 6 of the casing 1, so that noise produced by the air flowing towards the carburetor 12 can be reduced to an extremely low level. Furthermore, the carburetor 12 and the air cleaner 13 are provided on opposite ends of the comparatively long communication pipe 15 so that the blow back of the mixture from the carburetor 12 to the air cleaner 13 due to the back pressure of the internal combustion engine 2 is avoided to suppress contamination of the air cleaner 13.

A throttle lever 16 for controlling the throttle valve of the carburetor 12 is mounted on an intermediate portion of the grip 6 of the casing 1. More specifically, the throttle lever 16 is supported for pivotal movement about a pivot shaft 31 mounted on the grip 6 such that a portion thereof projects downward and outward from the lower surface 32 of the grip 6. The front end 33 of the throttle lever 16 is disposed in a front portion of the grip 6 and is connected through a suitable linkage (not shown) to the throttle valve of the carburetor 12. A throttle lock-out 17 is pivotally supported by another pivot shaft 34 which is provided on a portion of the grip 6 above the throttle lever 16. The throttle lock-out 17 has a portion which projects upward and outward from the upper surface 35 of the grip 6. A compression spring 30 compressed substantially in a S-like form is disposed in the grip 6 and loaded between the rear end 36 of the throttle lever 16 and the rear end 37 of the throttle lock-out 17. The spring 30 biases the throttle lever 16 about the pivot shaft 31 clockwise as viewed in the drawing and biases the throttle lock-out 17 counter-clockwise as viewed in the drawing about the pivot shaft 34. Therefore, a hook-shaped front end 38 of the throttle lock-out 17 engages with the projection 39 formed on an upper part of the throttle lever 16 so as to normally lock the throttle lever 16 at an idle position as illustrated, thereby keeping the throttle valve of the carburetor 12 at an idle position. The throttle lever 16, the throttle lock-out 17 and the spring 30 are formed as an integral part from a suitable plastic.

In order to conduct a required work with this chain saw by accelerating the internal combustion engine 2, the operator grips the grip 6 of the casing 1 and presses down the throttle lock-out 17 against the action of the spring 30 by his palm thereby to cause the throttle lock-out 17 to pivot clockwise, whereby the front end 38 of the throttle lock-out 17 is moved away from the projection 39 of the throttle lever 16. The operator then pulls the throttle lever 16 with a finger of the hand on the grip 6 so as to cause the throttle lever 16 to pivot counter-clockwise so as to control the opening of the throttle valve of the carburetor 12 thereby accelerating the internal combustion engine 2. As the engine 2 is accelerated, a centrifugal clutch (not shown) provided on one end of the crankshaft 9 is brought into torque-transmitting condition so that the saw chain (not shown) is driven to conduct a work such as cutting of a tree.

A space 28 is formed in the casing 1 between the lower end of the internal combustion engine 2 and the bottom of the casing 20. The space 28 receives a fuel tank 18 and a lubricating oil tank 19. More specifically, the fuel tank 18 occupies a portion of the space 28 between the lower surface of the crankcase 5 and the wall of the casing 1 opposite to the cylinder 4. On the other hand, the lubricating oil tank 19 occupies a portion of the space 28 between the lower surface of the cylinder 4 and the wall of the casing 1 opposite to the crankcase 5. The fuel tank 18 and the lubricating oil tank 19 are formed integrally with each other from a suitable material such as a plastic in such a manner that they are integrally connected through a thin web-like connecting portion 21. Thus, the lubricating oil tank 19 is disposed in the vicinity of the cylinder 4 of the internal combustion engine 2 so that the lubricating oil stored in the lubricating oil tank 19 is heated by the heat from the cylinder 4 so as to maintain its fluidity. The fuel tank 18 is installed adjacent to the crankcase 5, i.e., remote from the cylinder 4, with a double-walled heat-insulating layer 29 interposed between itself and the crankcase 5, so that the transmission of heat to the fuel tank 18 and, hence, the temperature rise of the fuel in the fuel tank 18 are minimized. It is also to be appreciated that the thin web-like connecting portion 21 between the fuel tank 18 and the lubricating oil tank 19 exhibits a sufficient flexibility so as to facilitate installation of these tanks in the limited space in the casing 1. The fuel tank 18 and the lubricating oil tank 19 have respective pouring ports which are closed by removable lids 22 and 23, respectively. The rear end wall of the casing 1 has an opening which is covered by a swingable cover 26. The cover 26 is usually held in the closing position by means of a screw 27. When this cover 26 is opened after loosening of the screw 27, the spark plug 11 and the air cleaner 13 becomes accessible for easy demounting or protective maintenance.

What is claimed is:

1. A portable powered working machine comprising:

a casing;

a hollow grip formed integrally with said casing and extending from a front portion to a rear portion of the upper wall of said casing;

an internal combustion engine disposed in said casing such that its crankshaft extends transversely of said casing, said internal combustion engine having a cylinder arranged horizontally in a rear portion of said casing and a crankcase disposed in a front portion of said casing;

a carburetor disposed on a front side of said crankcase;

an air cleaner disposed in a rear portion of said grip; and a communication pipe extending through said grip portion in the longitudinal direction thereof and connected between said air cleaner and said carburetor so as to form an air passage.

2. A portable powered working machine according to claim 1, further comprising a fuel tank and a lubricating oil tank which are formed integrally such that they are connected through a thin web-like connecting portion, said lubricating oil tank being disposed in a portion of the space in said casing under said cylinder, while said fuel tank is disposed in a portion of the space in said casing under said crankcase.

3. A portable powered working machine according to claim 1, further comprising a throttle lever for controlling the operation of said internal combustion engine, a throttle lock-out for locking said throttle lever in the idle position, and a spring for urging said throttle lever and said throttle lock-out, said throttle lever, said throttle lock-out and said spring being formed as an integral part from a plastic.

* * * * *